US007167672B2

(12) United States Patent
Stafford et al.

(10) Patent No.: US 7,167,672 B2
(45) Date of Patent: Jan. 23, 2007

(54) METHOD AND DEVICE FOR CONVEYING WASTE TONER IN AN IMAGE FORMING DEVICE

(75) Inventors: Donald Wayne Stafford, Georgetown, KY (US); Robert Watson McAlpine, Lexington, KY (US); Franklin Joseph Palumbo, Nicholasville, KY (US); Alfred Louis Fahmy, Lexington, KY (US); Gregory Scott Tigges, Frankfort, KY (US); William Dale Smith, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 28 days.

(21) Appl. No.: 11/062,396

(22) Filed: Feb. 22, 2005

(65) Prior Publication Data

US 2006/0188302 A1 Aug. 24, 2006

(51) Int. Cl.
*G03G 21/10* (2006.01)
*G03G 21/12* (2006.01)

(52) U.S. Cl. ..... 399/360; 399/358; 399/359

(58) Field of Classification Search ..... 399/358, 399/360, 359
See application file for complete search history.

(56) References Cited

U.S. PATENT DOCUMENTS

| | | | | |
|---|---|---|---|---|
| 4,974,031 | A | 11/1990 | Kioso et al. | |
| 5,956,556 | A * | 9/1999 | Nakajima et al. | 399/359 |
| 6,460,763 | B1 * | 10/2002 | Yoshinaga et al. | 235/375 |
| 6,466,763 | B1 | 10/2002 | Campbell et al. | |
| 6,975,830 | B2 * | 12/2005 | Murakami et al. | 399/358 |
| 2005/0117945 | A1 * | 6/2005 | Lee | 399/358 |

* cited by examiner

*Primary Examiner*—David M. Gray
*Assistant Examiner*—Joseph S. Wong
(74) *Attorney, Agent, or Firm*—Coats and Bennett, PLLC

(57) ABSTRACT

A conveyor mechanism for moving waste toner within an interior of a waste toner reservoir. The conveyor mechanism has a first end positioned in proximity to an inlet into the waste toner reservoir, and a second end positioned vertically above the first end. The conveyor mechanism operates to move the toner from a lower position within the waste toner reservoir to the vertically elevated position. The conveyor device may allow for the capacity of the waste toner reservoir to be more fully utilized. In use, the conveyor device is activated and waste toner is moved into the upper reaches of the waste toner reservoir.

19 Claims, 5 Drawing Sheets

METHOD AND DEVICE FOR CONVEYING WASTE TONER IN AN IMAGE FORMING DEVICE

BACKGROUND

Image forming devices such as copiers, printers, facsimile machines, and the like, produce residual toner that is not used during the printing process. This residual toner should be removed from the image transfer area and stored in storage location. The storage location should be sized to hold an adequate amount of the waste toner prior to removal from the image forming device. One solution is to provide a large capacity waste toner reservoir that can hold a large amount of waste toner. However, it is desirable for the overall size of the image forming device to be as small as possible. Therefore, a mechanism is needed to maximize the amount of waste toner that can be stored within a waste toner reservoir.

The waste toner mechanism should utilize a majority of the storage space within the waste toner reservoir. Previous designs often need to be replaced prior to the majority of the storage capacity being filled by waste toner. This was often caused because there was no mechanism for directing the waste toner throughout the reservoir. Further, the waste toner mechanism should be constructed to prevent waste toner from leaking from the waste toner reservoir.

Many previous waste toner reservoirs were positioned with the reservoir inlet being positioned at the upper reaches of the waste toner reservoir. These designs could utilize gravity to cause the waste toner to fall into the reservoir without the need for any additional waste toner mechanism to move and direct the toner. However, with the demand for smaller overall sizes for the image forming devices, space constraints may not allow for the waste toner to be introduced into an upper section of the waste toner reservoir. Therefore, some mechanism is needed to move the toner from a toner inlet at a lower section of the waste toner reservoir into other, vertically higher areas.

SUMMARY

The present invention is directed to embodiments to move toner within an image forming device. One embodiment of the present invention is directed to a conveyor device to move waste toner within an interior of a waste toner reservoir. The conveyor device has a first end positioned in proximity to an inlet into the waste toner reservoir, and a second end positioned vertically above the first end. The conveyor device operates to move the toner from a lower position within the waste toner reservoir to the vertically elevated position.

DETAILED DESCRIPTION

Figure 1:
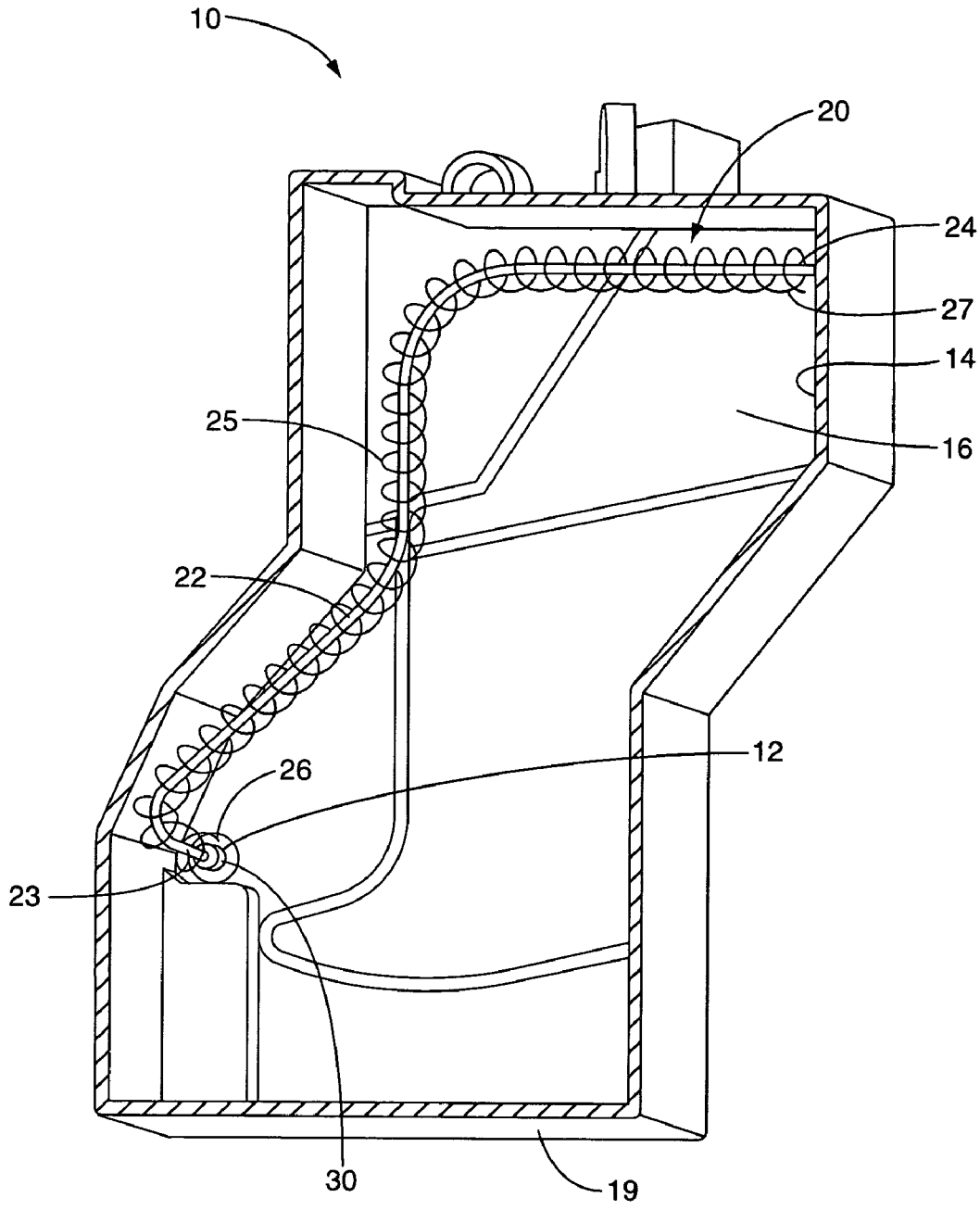
FIG. 1 is cut-away perspective view illustrating a conveyor mechanism positioned within an interior of a waste toner reservoir according to one embodiment of the present invention.

The present invention is directed to embodiments of a device for moving toner within a waste toner reservoir 10 of an image forming device. FIG. 1 illustrates an embodiment of the waste toner reservoir 10 having an inlet 12 through which waste toner is moved by a supply mechanism 30. A conveyor mechanism 20 is positioned within the waste toner reservoir 10 and moves the waste toner from the inlet 12 to a section vertically above the inlet 12.

Figure 2:
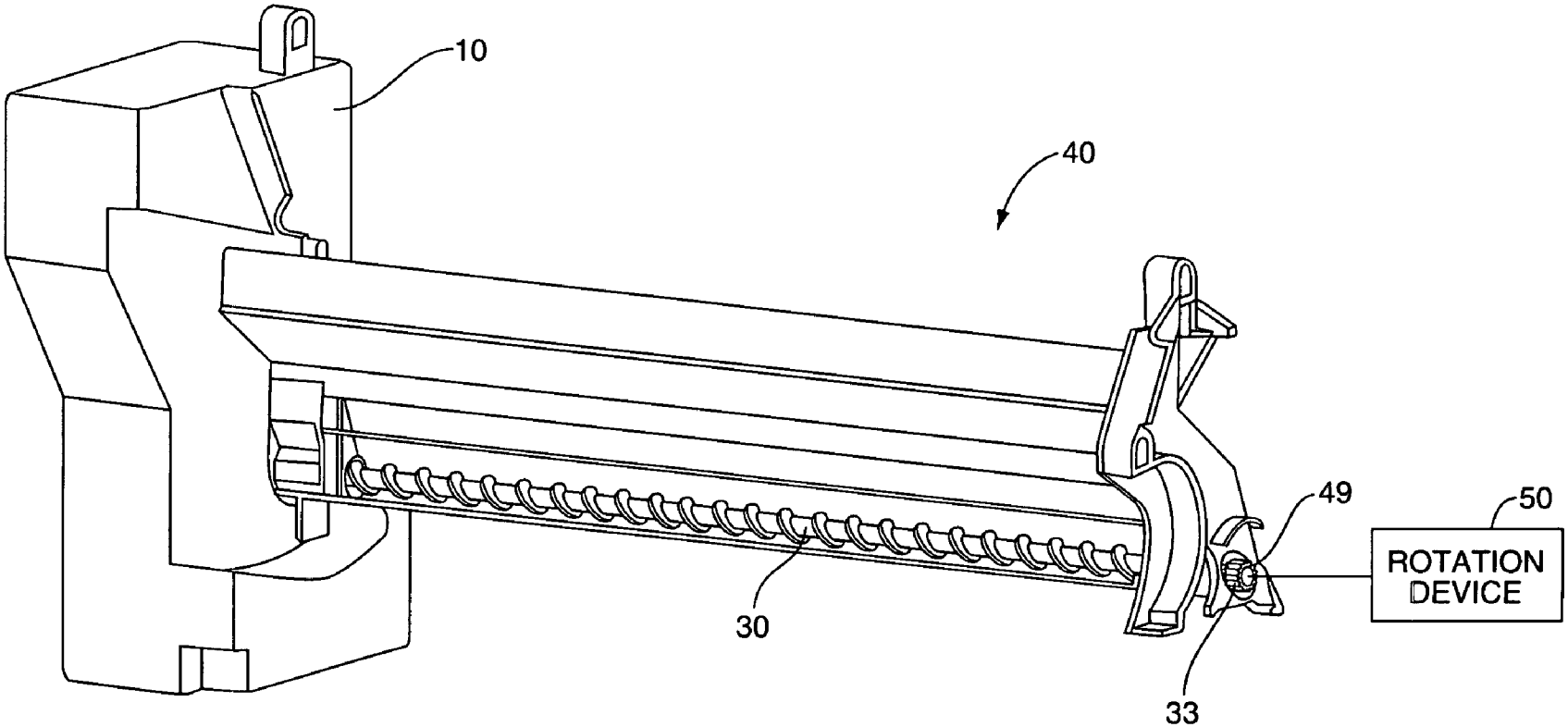
FIG. 2 is partial perspective view of a cartridge having a supply mechanism extending to a waste toner reservoir according to one embodiment of the present invention.

FIG. 2 illustrates one embodiment of a cartridge 40 that is mounted within the image forming device. The image forming device includes one or more cartridges 40 that each have a photoconductive member that transfers a toner image to a media sheet. Residual waste toner that is transferred to the photoconductive drum but not transferred to the media sheet is removed. The cartridge 40 includes a waste toner supply mechanism 30 that removes the residual waste toner from the cartridge 40 and moves it into the waste toner reservoir 10. For purposes of clarity, the photoconductive member is not illustrated in FIG. 2 to allow for viewing the supply mechanism 30.

The supply mechanism 30 has an elongated shape that extends the length of the cartridge 40. In this embodiment, the supply mechanism is a screw auger having a central shaft and helical fins that extend around the shaft. A first end of the supply mechanism 30 extends towards the waste toner reservoir 10, with a second end 33 at the opposite side of the cartridge 40. A rotation device 50 is operatively connected to the second end 33 to rotate the supply mechanism. In one embodiment, the cartridge 40 includes a gear 49 that operatively connects with a gear train (not illustrated) in a main printer body. The gear train in the main printer body is driven by a main printer body power supply. When the cartridge 40 is mounted in the main body, cartridge gear 49 mates with the main body gear train and the rotation device 50 causes rotation of the supply mechanism 30 to move the waste toner from the cartridge 40 towards the waste toner reservoir 10.

Figure 3:
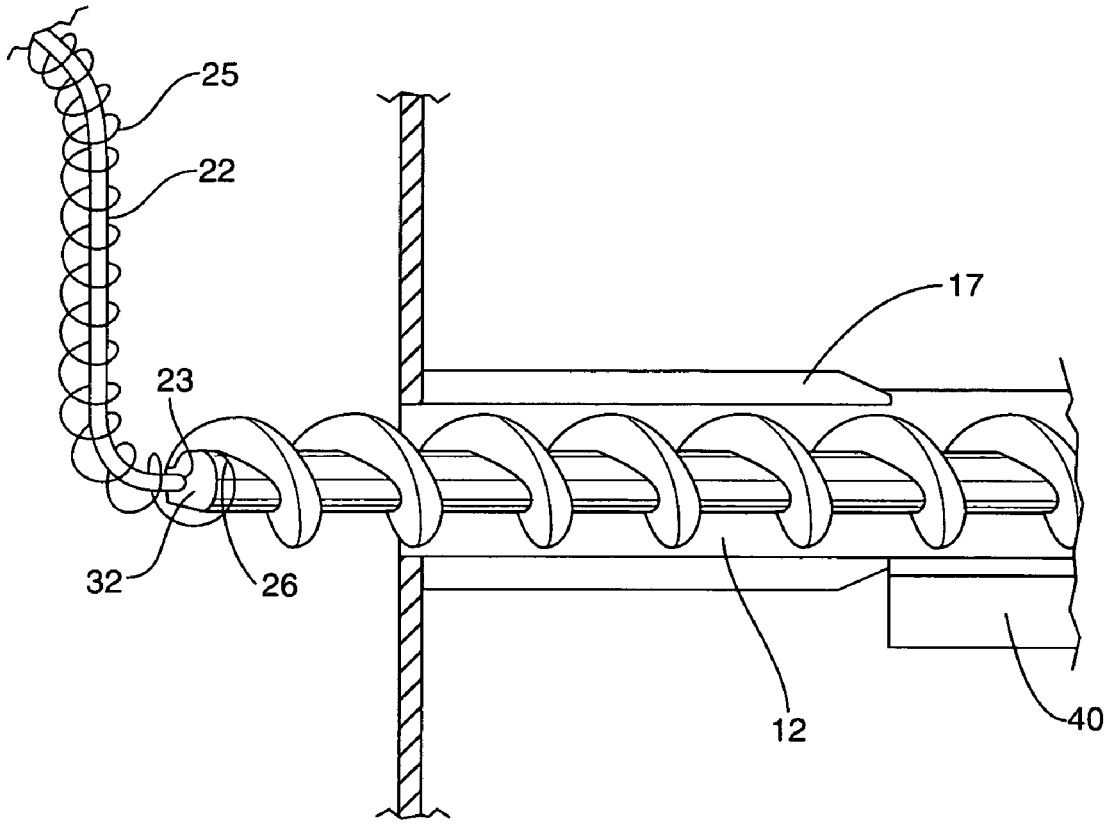
FIG. 3 is a cross-sectional view of the interior of the waste toner reservoir with the connection between the supply mechanism and conveyor mechanism according to one embodiment of the present invention.

FIGS. 1 and 3 illustrate embodiments of the structure that moves the waste toner from the cartridge 40 into and through the waste toner reservoir 10. The conveyor mechanism 20 is positioned within the interior of the waste toner reservoir 10 and moves the waste toner away from the inlet 12 towards a vertically higher section 16 within the reservoir. In these embodiments, the conveyor mechanism 20 comprises a guide 22 and a wire auger 25. The guide 20 has a first end 23 attached to the first end 32 of the supply mechanism 30 and a second end 24 attached to an interior wall 14 of the waste toner reservoir 10. In one embodiment, the guide 22 has a circular cross-sectional shape and is constructed of about 2 mm diameter wire.

The wire auger 25 has a helical configuration that extends around the guide 22. A first end 26 of the wire auger 25 is connected to the supply mechanism 32, and a second end 27 is positioned in proximity to the second end 24 of the guide 22. The wire auger 25 is loosely positioned around the guide 22 to rotate and direct the waste toner at the inlet 12 towards the vertically elevated section 16 of the waste toner reservoir 10. The wire auger 25 may be more flexible than the guide 22 to conform to the curved shape of the guide 22. The helical shape prevents the wire auger 25 from detaching from the supply mechanism 30, even during rotation. The second end 27 of the wire auger 25 is loose (i.e., not connected with the inner wall of the waste toner reservoir 10) allowing it to rotate about the guide 22. In one embodiment, the wire auger 25 is constructed of a metal strip about 0.5 mm thick by about 3 mm wide.

The guide 22 and the wire auger 25 may be positioned within an interior of the waste toner reservoir 10. This positioning prevents the auger 25 from contacting the inner edges of the waste toner reservoir 10 which could create noise which is audible to a user, or cause wear which could result in waste toner leakage.

In this embodiment, the first end 26 of the wire auger 25 is attached to the first end 32 of the supply mechanism 30 by wrapping around the supply mechanism 30. In one embodiment, a first end 26 of the wire auger 25 is positioned within a hole on the periphery of the supply mechanism 30. The connection causes rotation of the wire auger 25 through the rotation of the supply mechanism 30. Therefore, the rotation device 50 that drives the supply mechanism 30 also rotates the wire auger 25. The direct connection between the wire auger 25 and supply mechanism 30 also facilitates movement of the waste toner as there is no void or gap in the mechanisms that move the waste toner. Instead, the waste toner is directly transferred from the supply mechanism 30 to the wire auger 25.

The first end 23 of the guide 22 may also be attached to the end of the supply mechanism 30. In one embodiment, the first end 23 of the guide 22 is mounted within an opening centered within the first end 32 of the supply mechanism 30 as illustrated in FIG. 3. The connection provides for the first end 23 of the guide 22 to remain stationary during rotation of the supply mechanism 30. This may be achieved through a swivel mechanism (not illustrated) positioned between the supply mechanism 30 and the first end 23 of the guide 22. In another embodiment, an opening in the first end 32 of the supply mechanism 30 is larger than the first end 23 of the guide 22. The first end 23 of the guide 22 is positioned within the opening, but does not contact the supply mechanism 30 and therefore rotation is not imparted to the guide 22.

Figure 4:
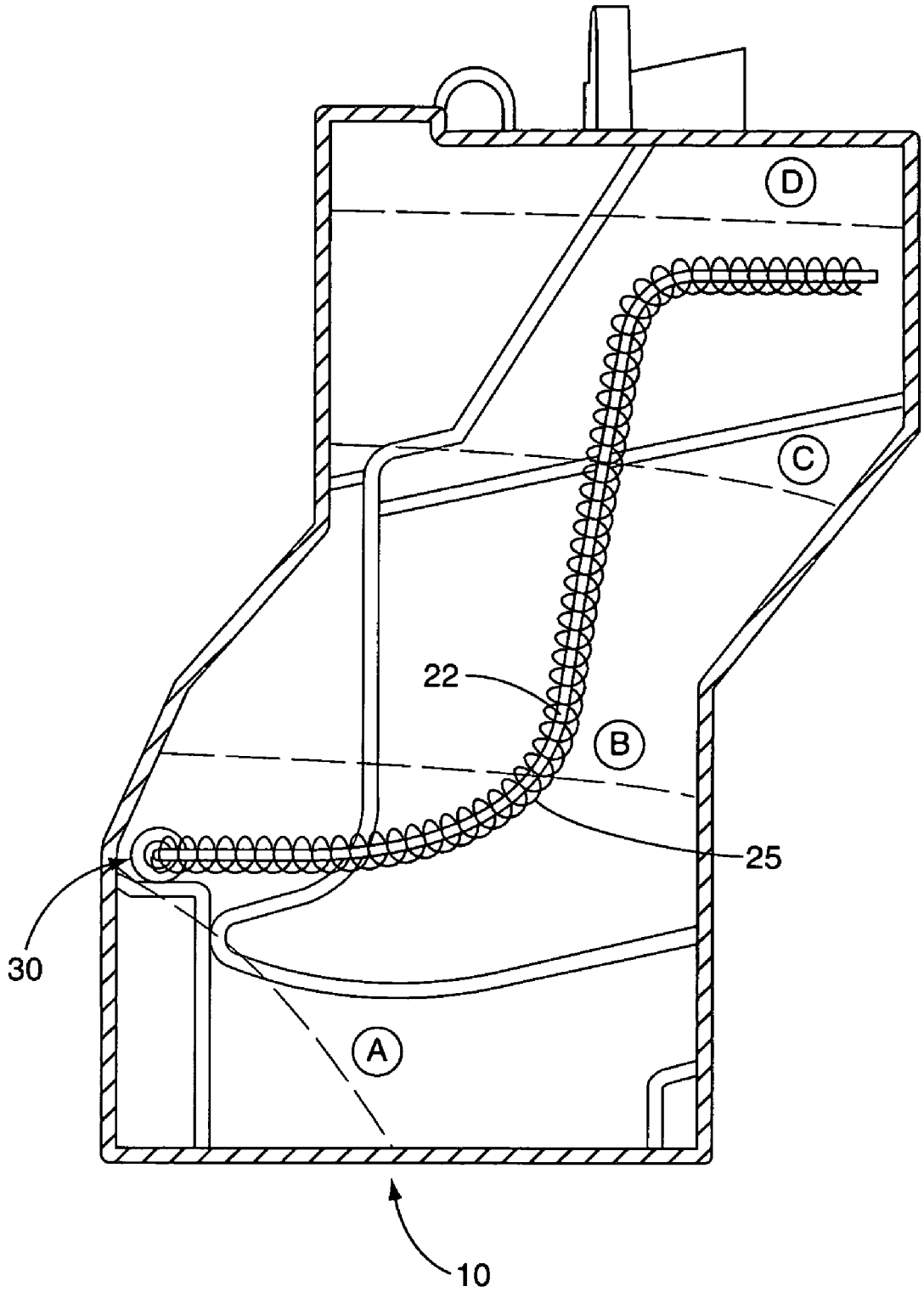
FIG. 4 is a cut-away view of the waste toner reservoir with schematic representations of the accumulation of the waste toner reservoir according to one embodiment of the present invention.

The orientation of the conveyor mechanism 20 moves the waste toner from the inlet 12 to an elevated positioned within the waste toner reservoir 10. FIG. 4 illustrates the movement of the waste toner as it accumulates. An initial amount of waste toner that enters the reservoir 10 will fall below the inlet through gravity and accumulate as illustrated in line A. This waste toner is not moved by the conveyor mechanism 20 and the waste toner accumulates in a pile having a peak. As more waste toner is introduced into the reservoir 10 to a level just above the inlet 12, the conveyor mechanism 20 aids the supply mechanism 30 in pulling the waste toner into the reservoir 10 and laterally distributing the toner as illustrated in line B. As additional toner is introduced, the conveyor mechanism 20 moves the toner vertically upward as illustrated in line C. This progression continues as the toner is distributed vertically and laterally as illustrated in line D. The conveyor mechanism 20 agitates the toner and minimizes the height of the peak of the rising pile. The waste toner is more fluid and level, and is better able to fill the upper corners of the reservoir 10.

As the toner level rises within the reservoir 10, the conveyor mechanism 20 aids the supply mechanism 30 in pulling toner into the reservoir 10, and provides a channel to pull the toner to the top of the reservoir 10. Since the toner is being actively pulled instead of being pushed from below by the conveyor mechanism 20, the toner remains more fluid which reduces the overall torque on the system and the demands on the rotation device 50.

FIG. 3 illustrates on embodiment with the end 32 of the supply mechanism 30 extending into the waste toner reservoir 10. In another embodiment, the end of the supply mechanism 30 stops within the inlet 17 and does not extend into the reservoir 10. In either embodiment, the conveyor mechanism 20 may or may not be attached to the supply mechanism 30.

In one embodiment, the conveyor mechanism 20 is positioned away from the inlet 12. The first end of the conveyor mechanism is positioned at a first vertical position that is distanced from the inlet 12 with the second end positioned at an elevated second position. In one embodiment, the first end of the conveyor mechanism 20 is positioned in proximity to a bottom wall 19. Further, the conveyor mechanism 20 is powered by a separate device than the supply mechanism 30.

Figure 5:
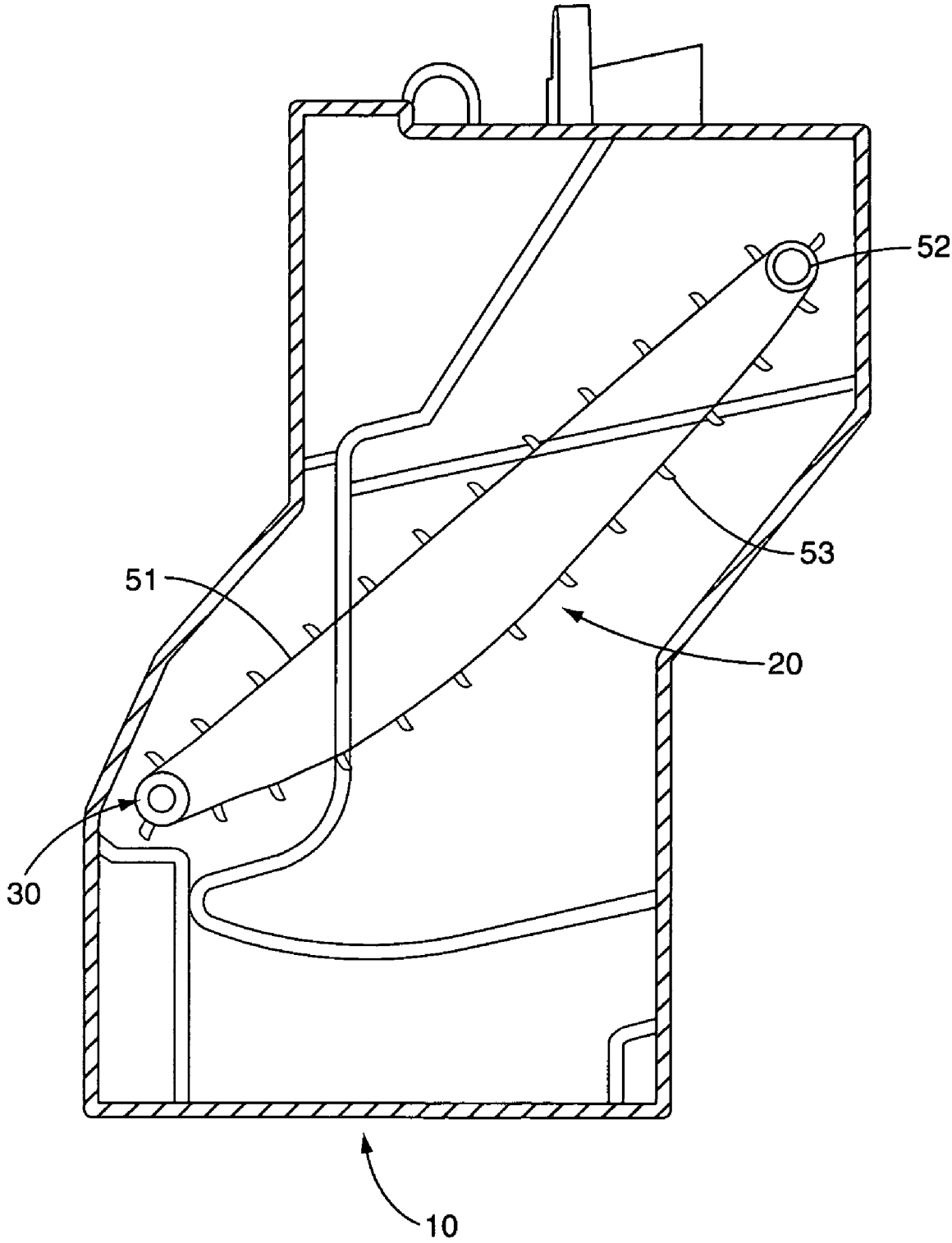
FIG. 5 is a cut-away view of the waste toner reservoir with a conveyor mechanism according to one embodiment of the present invention.

FIG. 5 illustrates another embodiment of the conveyor mechanism 20. A belt 51 is positioned within the interior of the waste toner reservoir 10 and extends around the supply mechanism 30 and a support member 52. The belt 51 may be constructed of a flexible material and have a thickness less than or equal to the thickness of the reservoir 10. Extensions 53 extend outward from the belt 51 and are sized and shaped to convey toner. In one embodiment, the extensions 53 have a cupped configuration that holds the toner as it is being vertically moved within the reservoir 10. As the belt 51 moves around the support member 52, the extensions 53 are tipped and the toner is dumped into the reservoir 10. The number, shape, and size of the extensions 53 may vary depending upon the requirements of the device.

The lower end of the belt 51 may extend around the supply mechanism 30. The contact between the belt 51 and supply mechanism 30 is sufficient to cause the belt to move. In one embodiment, the supply mechanism second end 32 has a channel to receive and maintain the position of the belt 51. In another embodiment, belt 51 is driven by a separate mechanism positioned at a vertically lower position within the reservoir 10.

The support member 52 is positioned at a vertically elevated position above the inlet 12. The support member 52 may include a circular member about which the belt 51 moves. In one embodiment, support member 52 comprises a rotating member.

The embodiment of FIG. 5 operates in a similar manner to the other embodiments. Toner is moved into the reservoir 10 through the inlet 12. The belt 51 is rotated and the waste toner is captured and held in the extensions 53. The angle of the belt 51 within the reservoir 10 causes little to no toner to fall from the extensions 53 until they approach the support member 52. The toner falls from the extensions 53 as they move around the support member 52. The extensions 53 also assist to agitate the toner.

The image forming device may produce color or single color images. For multi-color images, a plurality of different cartridges 40 each containing a different color of toner produce a composite toner image in an overlapping fashion. For single-color devices, a single cartridge, usually black, produces the toner image. The image forming device may include an intermediate transfer mechanism that receives the toner image from each cartridge and then transfers the toner images to the media sheet. Alternatively, the image forming device may be a direct transfer with the media sheet being moved past each cartridge and the toner image being transferred directly to the sheet. Examples of image forming devices include Model Numbers C750, C752, C760, and C762, each available from Lexmark International, Inc., of Lexington, Ky., which is the assignee of the present invention.

The waste toner reservoir 10 illustrated in FIG. 2 is a part of the cartridge 40. In another embodiment, a common waste toner reservoir is mounted within the main device body and receives waste toner from a plurality of cartridges. The conveyor mechanism 20 is vertically positioned within this reservoir to again vertically move waste toner within the interior of the reservoir.

The present invention may be carried out in other specific ways than those herein set forth without departing from the scope and essential characteristics of the invention. In one embodiment, the supply mechanism 30 is a wire auger. In one embodiment as illustrated in FIG. 4, the second end 24 of the guide 22 is spaced away from the wall 14 of the waste toner reservoir 10. In one embodiment, the overall length of the wire auger 25 is about equal to the guide 22. The conveyor mechanism 20 illustrated in FIG. 5 may rotate in either direction (i.e., clockwise or counter-clockwise). The present embodiments are, therefore, to be considered in all respects as illustrative and not restrictive, and all changes coming within the meaning and equivalency range of the appended claims are intended to be embraced therein.

What is claimed is:

1. A device to move waste toner within an image forming apparatus, the device comprising:

a waste toner reservoir having an inlet and a first section positioned vertically above the inlet;

a supply mechanism that extends along a cartridge and moves the waste toner from the cartridge and into the inlet of the waste toner reservoir;

a conveyor mechanism positioned within the interior of the waste toner reservoir, the conveyor mechanism having a first end operatively connected to the supply mechanism and a second end positioned within the first section to vertically move the waste toner from the inlet and into the first section; and a rotating device operatively mounted to the supply mechanism at a point opposite from the inlet, wherein the rotating device rotates the supply mechanism and the conveyor mechanism.

2. The device of claim 1, wherein the second end is laterally offset from the inlet.

3. The device of claim 1, wherein the supply mechanism is a screw auger having a central shaft and helical fins extending around the shaft.

4. The device of claim 1, wherein the conveyor mechanism comprises a guide and a wire auger extending around the guide.

5. The device of claim 4, wherein a first guide end is connected to the supply mechanism and a first wire auger end is connected to the supply mechanism.

6. The device of claim 1, wherein the conveyor mechanism has a curved configuration.

7. The device of claim 1, wherein the supply mechanism extends into the interior of the waste toner reservoir.

8. The device of claim 1, wherein the conveyor mechanism comprises a belt having one or more outwardly-extending extensions.

9. The device of claim 8, further comprising a support member positioned within the first section of the waste toner reservoir, the belt extending around the supply mechanism and the support member.

10. A device to move waste toner within a waste toner reservoir having an inlet and a first section positioned vertically above the inlet, the device comprising:

a supply mechanism extending into the inlet to move toner through the inlet and into an interior of the waste toner reservoir;

a guide member positioned within the waste toner reservoir and having a first end attached to the supply mechanism and a second end that extends to a point above the inlet; and a wire auger positioned within the waste toner reservoir and having a helical configuration that wraps around the guide member, the wire auger having a first wire auger end attached to the supply mechanism with rotation of the supply mechanism causing rotation of the wire auger to move toner from the inlet towards the second end.

11. The device of claim 10, wherein the wire auger has an overall length about equal to the length of the guide member.

12. The device of claim 10, further comprising a connection mechanism to attach the first end of the guide member to the supply mechanism to prevent the guide member from rotating during rotation of the supply mechanism.

13. The device of claim 10, wherein the wire auger is wrapped around an end of the supply mechanism causing rotation of the wire auger during rotation of the supply mechanism.

14. The device of claim 10, wherein the second end is laterally offset from the inlet within the waste toner reservoir.

15. The device of claim 10, further comprising a rotation device to rotated the supply mechanism and the wire auger.

16. An image forming apparatus comprising:

a waste toner reservoir having an inlet and a first section vertically above the inlet;

a supply mechanism that extends within a cartridge and moves the waste toner from the cartridge and into the waste toner reservoir;

a guide member having a first guide member end attached to the supply mechanism and a second guide member end terminating within the first section; and a wire auger having a helical configuration that wraps around the guide member, the wire auger having a first wire auger end attached to the supply mechanism with rotation of the supply mechanism causing rotation of the wire auger to move toner from the inlet towards the first section.

17. A method of moving waste toner within an image forming device, the method comprising the steps of:

rotating a supply mechanism and moving the waste toner into a waste toner reservoir;

maintaining a guide member that is connected to the supply mechanism relatively stationary during rotation of the supply mechanism; and rotating the supply mechanism and causing rotation of a wire auger within the waste toner reservoir and vertically moving the waste toner from the inlet towards a point vertically above the inlet.

18. The method of claim 17, further comprising laterally moving the waste toner from the inlet towards the point vertically above the inlet.

19. A method of moving waste toner within an image forming device, the method comprising the steps of:

rotating a supply mechanism and moving the waste toner from a cartridge and into a waste toner reservoir; and connecting a vertically orientated auger positioned within the waste toner reservoir to the supply mechanism with rotation of the supply mechanism causing rotation of the auger to move the waste toner from the inlet towards a point vertically above the inlet.

* * * * *